US006488257B2

(12) United States Patent
McSwain

(10) Patent No.: US 6,488,257 B2
(45) Date of Patent: Dec. 3, 2002

(54) ATTACH PLATE BRACKET FOR STRUCTURAL CONCRETE FORMING

(76) Inventor: Gregory A. McSwain, 4448 Schmittwoods Ct., St. Louis, MO (US) 63123

( * ) Notice: Subject to any disclaimer, the term of this patent is extended or adjusted under 35 U.S.C. 154(b) by 0 days.

(21) Appl. No.: 09/735,772

(22) Filed: Dec. 13, 2000

(65) Prior Publication Data

US 2002/0020799 A1 Feb. 21, 2002

Related U.S. Application Data

(60) Provisional application No. 60/170,503, filed on Dec. 13, 1999.

(51) Int. Cl.[7] ..... E04G 17/00; E04G 17/14

(52) U.S. Cl. ..... 249/219.2; 52/127.2; 52/655.1; 52/737.2; 52/737.3; 52/736.2; 403/348

(58) Field of Search ..... 249/219.1, 219.2, 249/47; 52/651.1, 737.3, 729.1, 729.2, 729.4, 736.2, 737.2, 653.1, 655.1, 127.2; 403/348, 396, 400, 346, 385, 387, 388, 408.1; 411/398, 400, 401

(56) References Cited

U.S. PATENT DOCUMENTS

| | | | | | |
|---|---|---|---|---|---|
| 1,245,477 | A | * | 11/1917 | Loxterman | 249/219.2 X |
| 1,414,756 | A | | 5/1922 | Starck | |
| 1,552,334 | A | * | 1/1925 | Mosher | 249/219.1 X |
| 2,188,400 | A | * | 1/1940 | Bosco | 249/219.2 X |
| 2,379,752 | A | * | 7/1945 | Schultz | 411/401 X |
| 2,415,207 | A | | 2/1947 | Goranson | |
| 2,452,203 | A | * | 10/1948 | Luppino | 249/219.2 |
| 2,993,254 | A | | 7/1961 | Larson | |
| 3,075,622 | A | * | 1/1963 | Attwood | 411/400 X |
| 3,120,941 | A | | 2/1964 | Cameron | |
| 3,197,822 | A | * | 8/1965 | Herrschaft | 403/387 |
| 3,330,086 | A | | 7/1967 | Schlass | |
| 3,442,482 | A | * | 5/1969 | Preblich | 249/219.2 |
| 4,034,957 | A | * | 7/1977 | Cody | 249/189 |
| 4,254,932 | A | * | 3/1981 | Durbin | 249/219.2 X |
| 4,350,318 | A | * | 9/1982 | Gallis | 249/219.2 X |
| 4,791,767 | A | * | 12/1988 | Boeshart | 249/219.2 X |
| 4,846,433 | A | | 7/1989 | Courtois et al. | |
| 4,913,016 | A | | 4/1990 | Frei | |
| 5,234,188 | A | | 8/1993 | McSwain | |
| 5,271,596 | A | | 12/1993 | Holcomb et al. | |
| 5,277,405 | A | | 1/1994 | McSwain | |
| 5,398,909 | A | * | 3/1995 | Sandwith | 249/219.2 X |
| 5,524,854 | A | | 6/1996 | McSwain et al. | |

FOREIGN PATENT DOCUMENTS

| | | | |
|---|---|---|---|
| DE | 903103 | 7/1949 | |
| DE | 810081 | 12/1953 | |
| DE | 180714 | 1/1955 | |
| DE | 186835 | 9/1956 | |
| FR | 1119804 | 1/1955 | |
| FR | 1187154 | 11/1957 | |
| GB | 729650 | 6/1953 | |
| GB | 1410993 | * 10/1975 | 403/348 |

* cited by examiner

*Primary Examiner*—Laura A. Callo
(74) *Attorney, Agent, or Firm*—Paul M. Denk

(57) ABSTRACT

A structural attaching plate bracket system for use to temporarily support the forms used to construct concrete walls, slabs, or foundations. The structural attaching plate bracket system includes a linear plate affixed to a support member with removable fasteners. The attached plate bracket is positioned long the full length of the support member. Mounting devices included attach surfaces which are provided along the full length of the support members. A series of brackets are positioned intermediate along the attached plate brackets for attachment of a load bearing member into the concrete wall construction. The brackets can be positioned intermediate along the attached plate brackets for the attachment for two or more load bearing members in the concrete wall construction. The attached plate brackets includes an integral attachment fastener to secure the load bearing members to the attached plate bracket where attachment of the bracket to the load bearing member in the concrete wall, slab and foundation construction.

20 Claims, 12 Drawing Sheets

ATTACH PLATE BRACKET FOR STRUCTURAL CONCRETE FORMING

This application claims benefit of Provisional Serial No. 60/170,503 filed Dec. 13, 1999.

BACKGROUND OF THE INVENTION

The present invention relates to a concrete form structural attaching plate system, and more particularly, to a structural attaching plate system for the use as temporary attachment, such as in concrete falsework forming for bridge deck, concrete slab construction, concrete wall construction and the like.

Various types of structural concrete attach systems are used to assemble concrete falsework forms in bridge deck overhang concrete, concrete slab construction, concrete wall construction and the like. Most of such structural attach systems incorporate a fastener or wedge assembly component that serves as a structural-attaching component in the system. For example, one such system made by Universal form clamp co., Bellwood, Ill. includes a coil loop straight insert, which incorporates a single or double coil loop component. The double loop component allows a fastener to be used through the loops and through a support member. The support member, wood, steel, or the like is attached to a system of load carrying components to control the pressure or weight of a concrete form or slab. Plywood or other forms of sheathing is attached to the support member to mold or form the surface of structural concrete. The load carrying components are spaced according to their load carrying capacity along the length of the support member. The support member is held into a firm position using the coil loop straight insert and against the support component. A load-carrying tie is positioned through the load carrying component, between the support members and through the plywood or sheathing. The various locations and spacing of the load carrying component along the support member requires a hole that is fixed in location for the fastener.

Another type of system is shown in the B3S L-Bolts made by the Williams Form Engineering Corporation of Grand rapids, Mich. includes an L-shaped rod, threaded on each end, which is attached to a support member. The support member is attached to an alignment member or load-carrying member at the free end of the L-Bolt. Plywood or sheathing is attached to the support member for the molding or support of structural concrete. A hole that has a fixed location must be incorporated and positioned in the support member to attach the L-Bolt.

Another type of system is shown in the F1D-02 made by the Williams Form Engineering Corporation of Grand Rapids, Mich. includes a wedge type L-Bolt, which has a pressed recess on each end of the L-Bolt. The pressed recess incorporates as wedge device to tighten against the support member. The support member is attached to an alignment member or load-carrying member at the free end of the L-Bolt. Plywood or sheathing is attached to the support member for the molding or support of structural concrete. A hole that has a fixed location must be incorporated and positioned in the support member to attach the wedge type L-Bolt.

Another type of system is shown in the F1D-06 made by the Williams Form Engineering Corporation of Grand Rapids, Mich. includes a steel plate for positioning the support member onto the load carrying component. The attachment plate incorporates a series of holes to fix the attach plate to the support member. The load-carrying member is then set atop the plate and supported by the attachment plate. Plywood or sheathing is attached to the support member for the molding or support of structural concrete. A fixed steel plate location must be positioned. in the support member to attach the load-carrying member.

Another type of system is shown in the F2E Coil Waler Holder made by the Williams Form Engineering Corporation of Grand Rapids, Mich. includes a coil thread welded to an attachment plate forming an attachment holder which is fastened to a support member. A coil bolt fastener and plate is used to attach the load carrying member to the support member. Plywood or sheathing is attached to the support member for the molding or support of structural concrete. An attachment holder is positioned and attached for each load-carrying member.

Another type of system is shown in the B9G Slotted coil bolt made by the Williams Form Engineering Corporation of Grand Rapids, Mich. includes a threaded fastener and attachment plate. The support member is attached to a modular forming surface and is used can be used as an alignment component or load-bearing member. The modular forming component is used for the molding or support of structural concrete. A fixed position must be incorporated into the modular forming surface to attach the support component.

Another type of system is shown in the A2I linear clamp made by the Williams Form Engineering Corporation of Grand Rapids, Mich. includes an attachment plate, a looped rod component and a rotating wedge. The attachment plate is fastened to a support member and the looped rod encases the load carrying or alignment member. The wedge component is engaged onto the load carrying or alignment member and tightened. Plywood or sheathing is attached to the support member for the molding or support of structural concrete. The attachment plate must be positioned and fixed on the support member for each alignment or load-bearing member attachment. As the spacing of the alignment or load-bearing member is changed, the attachment plate must be moved or an additional A2I system installed.

Another type of attach system is shown in the Cam-Lock Forming System, which is made by Gates & Sons, Inc. of Denver, Colo. which includes a cam lock bracket and lever assembly. The support member is attached to the plywood or sheathing using the cam lock bracket and a load-bearing tie assembly. Plywood or sheathing is attached to the support member for the molding or support of structural concrete. The support member will support the plywood or sheathing between each cam lock bracket. The alignment member is attached to the support member with the use of a stiff-back cam. A hole must be positioned in the plywood or sheathing to locate and position the cam lock bracket. A cam lock bracket must be fixed and positioned to attach an alignment member. As the spacing of the cam lock bracket is required, a hole must be re-positioned into the plywood or sheathing for the attachment of the cam lock bracket. As the spacing of the stiff-back cam is required, the cam lock bracket must be re-positioned.

Another type of attach system, which is in the system made by Symons Corporation, of Des Plaines, Ill. include the use of a attachment clip, clamping nut and fastener bolt. The aluminum support member has a fixed formed slot along the length of the support member for the clamping nut engagement. The clamping nut is contained within the support member's formed slot and the attachment clip is fastened to the load-bearing member. The aluminum support member contains a wood nail strip to attach plywood or sheathing. Plywood or sheathing is attached to the support member for the molding or support of structural concrete. The formed slot in the support member is an integral component of the support member. The nail strip for plywood or sheathing attachment can be replaced, as usage requires.

Another type of attach system, which is in the system made by Doka International, of Deutsche Doka, Schalungstechnik GmbH, include the use of H20 flange clamp on an I-shaped wood support member, the attachment will include a U-shaped loop plate component and two fastener components. The U-shaped loop plate component will engage the flange of a steel load-carrying member and will engage the two fastener components on the opposite flange of the load-bearing member. The plate portion of the U-shaped loop plate component will engage the lower flange surface of the I-shaped wood support member. A fastening nut on the two fastening components will draw the plate portion of the U-shaped loop plate component against the lower flange surface of the I-shaped wood support member. Plywood or sheathing is attached to the I-shaped wood support member for the molding or support of structural concrete.

Another type of attach system, which is in the system made by Peri Formwork Engineering, of Peri GmbH, Weissenhorn, include the use of HB24-hook strap on an I-shaped lattice-web wood support member, the attachment will include a V-plate component and two fastener components. The V-plate component will engage through the open web portion the wood I-shaped support member. The hook portion of the attachment component will engage the flanges of a steel load-carrying member and will engage the V-plate component member. The V-shaped portion of the attachment component will engage against the web portion of the I-shaped wood support member. Plywood or sheathing is attached to the I-shaped wood support member for the molding or support of structural concrete.

Another type of attach system, which is in the system made by Peri Formwork Engineering, of Peri GmbH, Weissenhorn, include the use of the HB girder claw clamp used to attach an I-shaped wood support member, the attachment will include a claw-leg bearing component and a hooked threaded fastener component. The claw-leg-bearing component will engage the flange portion of the load-bearing member and the flange of the wood I-shaped support member. The hook portion of the attachment component will engage the flanges of the load-carrying member and through the claw-leg-bearing component. The threaded portion of the hook component will compress the claw leg component against the flange of the I-shaped wood support member using a fastener nut. The claw leg portion of the attachment component will bear against the flange portion of the I-shaped wood support member and the flange surface of the load-bearing member. Plywood or sheathing is attached to the I-shaped wood support member for the molding or support of structural concrete.

Another type of attach system, which is in the system made by SGB—Scaffold Great Britain, of SGB International, include the use of the timber waling clamp used to attach a wood support member, the attachment will include a U-shaped bearing component and a J bolt threaded fastener component. The U-shaped bearing component will engage the flange portion of the load-bearing member and the threaded J-Bolt threaded fastener component attached to the wood member. The hook portion of the U-shaped bearing component will engage the flanges of the load-carrying member and against the wood member. The threaded portion of the J-bolt component will compress the U-shaped bearing component against the wood support member using a fastener nut. Plywood or sheathing is attached to the wood support member for the molding or support of structural concrete.

Another type of attach system, which is in the system made by SGB—Scaffold Great Britain, of SGB International, include the use of the Universal Anchor Clamp used to attach an T150 Aluminum support member, the attachment will include a U-shaped bearing component and a T-bolt threaded fastener component. The U-shaped bearing component will engage the flange portion of the load-bearing member and the threaded T-Bolt threaded fastener component attached to the T150 Aluminum support. The hook portion of the U-shaped bearing component will engage the flanges of the load-carrying member and against the T150 Aluminum support. The threaded portion of the T-bolt component will compress the U-shaped bearing component against the wood support member using a fastener nut. Plywood or sheathing is attached to the T150 Aluminum support for the molding or support of structural concrete.

While such aforementioned attachment systems have inherent advantages including being adjustable, providing good attachment characteristics, and being durable for long use, there are some inherent drawbacks. First of all, several of the above-mentioned structural attaching systems requires the support member incorporate a fixed location attachment hole for each attachment location. When the spacing or location of the load-bearing member, along the length of the support member, is to be changed, another hole must be located in a fixed location into the support member to make the attachment. Such prior art attachment require the attachment components pass through and against the outer surface of the load-bearing member to complete the system. The additional cost of such prior art devices is higher than it needs to be. These prior art systems are limited to the function set forth, when additional attach requirements, such as a different size or type of load-bearing component, would require a additional size attach component, which would increase the overall cost of the attach systems.

Other such drawbacks would be that particular prior art systems would require the support member be attached to the sheathing at a fixed location and have a support member attachment at all such locations to allow the load-bearing component an attachment location These systems limit the attachment from the support member to the load-bearing member by requiring that the sheathing be part of the attachment system. This would not provided the desired versatility an attachment system requires and thereby has limited the productivity of construction workers in using such prior art systems.

Other such drawbacks would be that particular prior art systems would require the support member be attached to the load carrying members at a fixed bearing location and have a support member attachment at all such locations to allow the load-bearing component an attachment location. These systems limit the attachment position of the load carrying member or sheathing for only a particular side of the support member to the load bearing member by requiring that the sheathing be attached to only one side of the support member and system. This would not provided the desired versatility an attachment system requires and thereby has limited the productivity of construction workers in using such prior art systems.

Other such drawbacks would be that particular prior art systems would require the support member is of such a shape or material to be of a cost that is higher than it needs to be. Such support members must incorporate a flange within the body of the support member to allow attachment and such flange is a permanent part of the support member. These support members must incorporate a separate device to allow additional attachment of sheathing for formwork molding or formwork support.

Other such drawbacks would be that particular prior art systems would require attachment components be of a cost that is higher than it needs to be. These support members are of such a shape that the attachment components be limited in their use. The shape of such attachment components would require a limited type of load-bearing member be used. These attachment components would be limited in their purpose or usage and would not provide the adjustability required to be used on other formwork molding or formwork support applications.

Other such drawbacks would be that particular prior art systems would only allow the support member to be attached to the load-bearing member in a fixed angle relative to the shape of the load-bearing member. Limiting the connection application of the support member to the load bearing member would restrict their purpose or usage and would not provide the adjustability required to be used on other formwork molding or formwork support applications.

SUMMARY OF THE INVENTION.

Among the several objects and advantages of the present invention include:

- The provision of a new and improved structural attaching plate system for use as a temporary attach in concrete wall formwork construction, concrete slab support construction and the like, for example, concrete wall forming in concrete bridge pier construction, which systems overcome the aforementioned deficiencies of the prior art;
- The provisions of the aforementioned structural attaching plate system which substantially reduces the amount of material and components required, as compared to prior art design, while increasing versatility, adjustability and productivity in the use of such systems;
- The provisions of the aforementioned structural attaching plate system would allow the use of conventional support members, support members of such shape and material to be economical;
- The provisions of the aforementioned structural attaching plate system that includes a linear attachment plate means used along the length of the support member. The attachment plate means provides adjustable attachment locations along the length of the support member, adjustment made as the attach requirements change in the concrete wall formwork construction, while permitting the adjustment of one attachment component along the length of the support member to increase or decrease the spacing thereof;
- The provisions of the aforementioned structural attaching plate system that include support members that are made from lightweight materials such as laminated veneer lumber, aluminum, composite materials and the like;
- The provisions of the aforementioned structural attaching plate system with the attach plate bracket affixed to the support member with removable fasteners;
- The provisions of the aforementioned structural attaching plate system with attach plate brackets affixed to one or two of the bearing surfaces of the support members;
- The provisions of the aforementioned structural attaching plate system with attach plate brackets affixed to the support member allowing the support member to be attached in a load-bearing member element location;
- The provisions of the aforementioned structural attaching plate system with attach plate brackets affixed to the support member allowing the support member to be connected to another support member;
- The provisions of the aforementioned structural attaching plate system with attach plate brackets affixed to the support member allowing the connection of various accessories as the construction environment demands;
- The provisions of the aforementioned structural attaching plate system which can be used on a variety of construction form settings and environment, depending upon the manner in which it is used;
- The provisions of the aforementioned structural attaching plate system which will allow the use of various attaching components to attach the load-bearing member, depending on the manner in which the support member is used;
- The provisions of the aforementioned structural attaching plate system which will allow the affixing of the load-bearing member at various angles relative to the support member, depending on the manner in which the support member is used;
- The provisions of the aforementioned structural attaching plate system which is inexpensive and easy to manufacture; is simple and easy to install and use; provides versatility and flexibility in the use of such systems in different construction environments; increases the productivity of construction workers in the use of such systems, is long wearing and durable in use; and is otherwise well adapted for the purposes intended.

Briefly stated, the structural attaching plate system of the present invention is constructed for the use in concrete wall forming in concrete falsework construction and the like and includes a linear plate affixed to a support member using removable fasteners. The structural attaching plate will allow the use of standard attaching components present in current construction environments. The attach plate bracket include mounting means for the connection of load-bearing members in concrete falsework construction and concrete wall forming and molding. Specifically, the mounting means include attach surfaces which occur along the full length of the support members. The mounting means allows the support member to also be used as a load-bearing member. The mounting means also allows the load-bearing member to be attached at various angles relative to the support member.

The support members captured by the attach plate bracket are formed from laminated veneer lumber or aluminum, or other equivalent structure, in order to provide a lightweight construction.

One attach plate bracket can be affixed to the side surface of a support member allowing the bearing surface to be uses to support sheathing elements or a attach plate bracket can be affixed to each side surface of a support member to provide this member as a load-bearing element. The attach plate bracket affixed to the support member provides for attachment along the full length of the support member as needed to the concrete form construction. The attaching means include an integral attach plate bracket which extends along the side surface of the support member. The plate has at least one, preferably many slotted holes to allow the engagement of removable fasteners.

The attach plate bracket can also allow the connection of various types of load-bearing members as the demands require.

These and other advantages of the present invention will become more apparent from the ensuing description.

BRIEF DESCRIPTION OF THE DRAWINGS

In the drawings.

Corresponding reference numbers will be used throughout the various figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode which is carrying out the invention.

Figure 1:
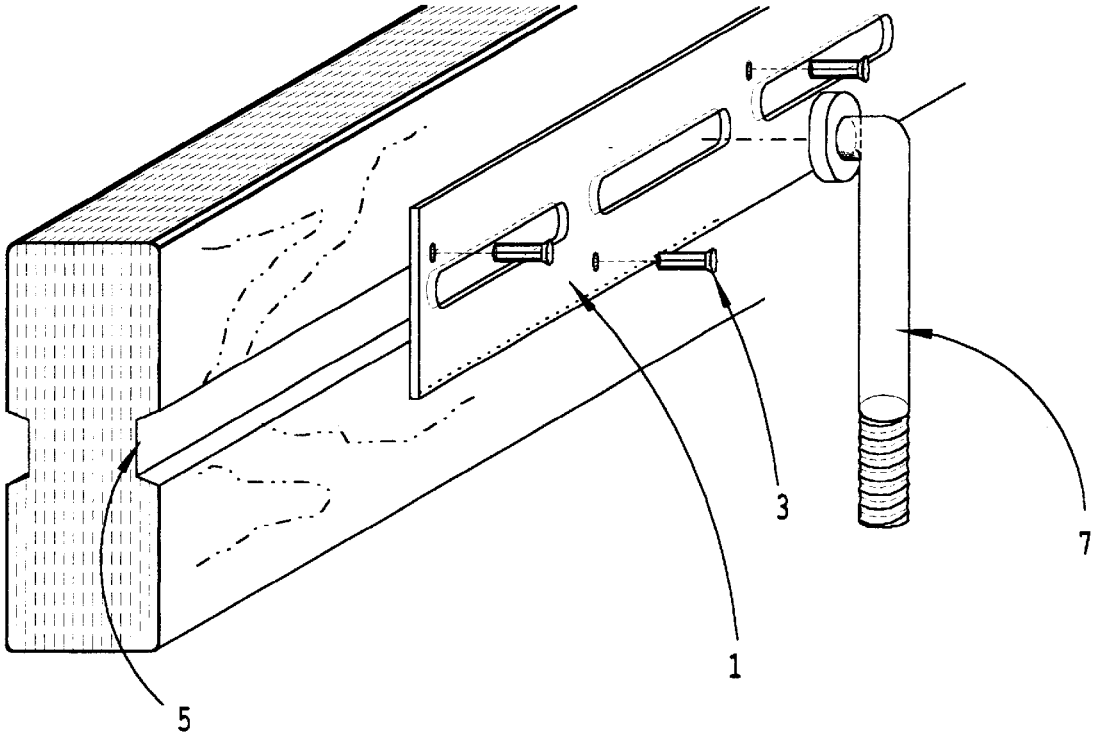
FIG. 1 is an isometric view of the structural attach plate bracket system of the invention including the support member and the associated attach plate bracket means at the side surface thereof, together with associated fastener means positioned, as the present invention is assembled for use as a support member component in formwork construction or concrete slab construction.
Figure 2:
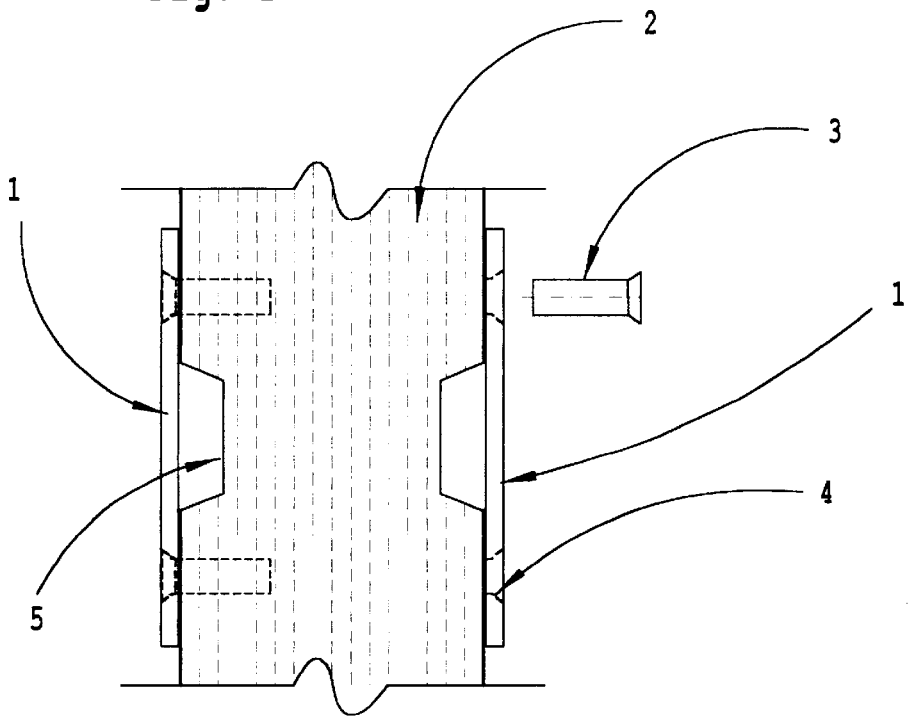
FIG. 2 is a fragmentary elevation end view illustrating the manner in which the structural attach plate bracket of the present invention is positioned used for the temporary attachment in concrete formwork construction or concrete slab support construction.

As best seen in FIGS. 1–2 of the drawing, the structural attaching plate bracket 1 of the present invention is essentially an attaching plate bracket which is constructed for use as a temporary attach in concrete formwork construction and concrete slab support construction and the like, i.e., bridge pier forming, where concrete formwork construction is required. In the concrete formwork and slab support environment the structural attaching plate system or attach plate bracket 1 of the present invention includes an attaching fastener 3, preferably removable, which is located by the means of an attach hole 4 within the body of the attach plate bracket 1. The attach plate bracket 1 is affixed to the support member 2 by the means of the equally spaced fasteners 3 along the full length of the support member 2. Access to the inner bearing surface of the attach plate bracket 1 is made by, but not limited to, the recess 5 in the support member 2. The attach plate bracket 1 is held in alignment to the support member 2 and in the linear relationship to the support member 2 which can best be illustrated in FIG. 2.

Figure 3:
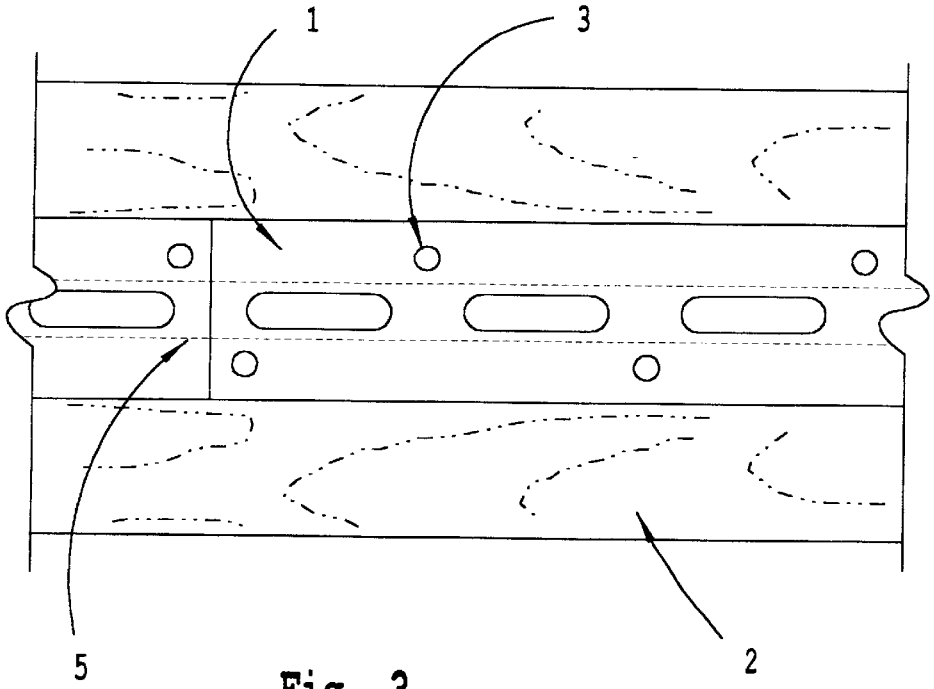
FIG. 3 is a fragmentary side elevation view of the support member and attach plate bracket used in the structural attaching plate system of the present invention.

For the above purposes, the attach plate bracket 1 shown in FIG. 3 of the drawings includes horizontally extending and equally spaced fasteners 3, the access recess 5 extending horizontally the full length of support member 2.

Figure 4:
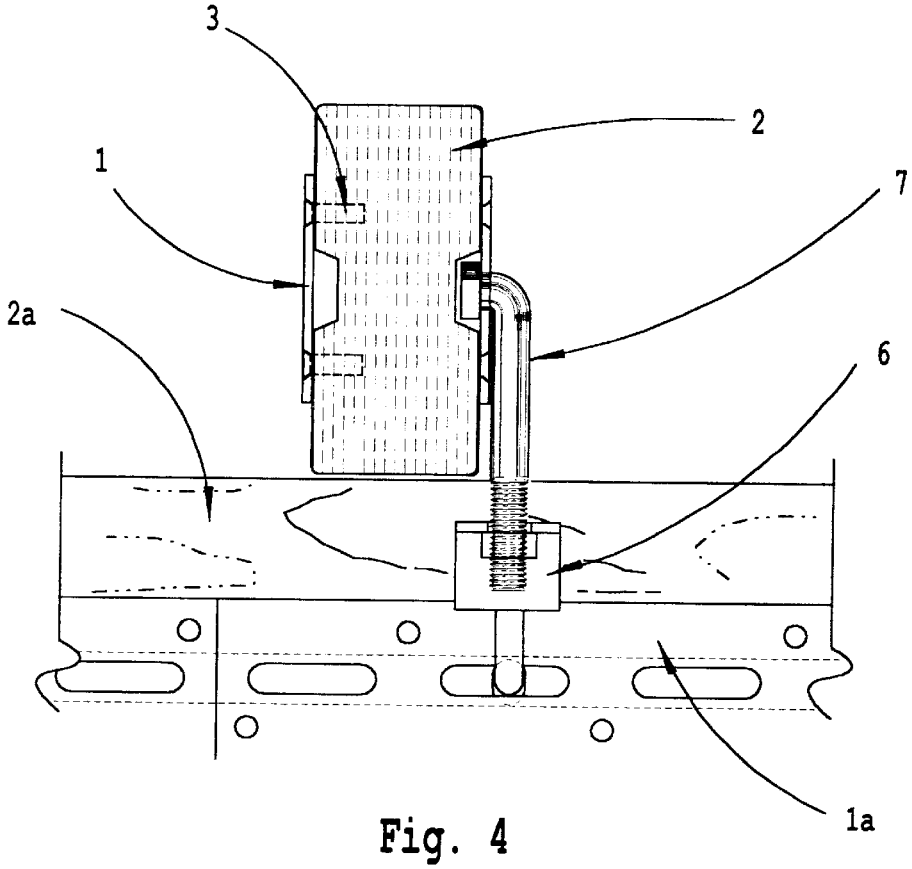
FIG. 4 is a fragmentary end elevation view illustrating the manner in which the attach plate bracket means of FIG. 3 is positioned in association with the load-bearing member and the associated attach clamp fastener in concrete formwork construction or concrete slab support construction.

As shown in FIG. 4 of the drawings the horizontally extending fasteners 3 are spaced alternately off center in the support member 2 for attachment of the attach plate bracket 1. For the purpose of temporary affixing the support member 2*a* and the attach plate bracket 1*a*, the support member 2 and the attach plate bracket 1 is held firmly in place by the means of an attach clamp 6 and the like, the opposite attach fastener 7.

Figure 5:
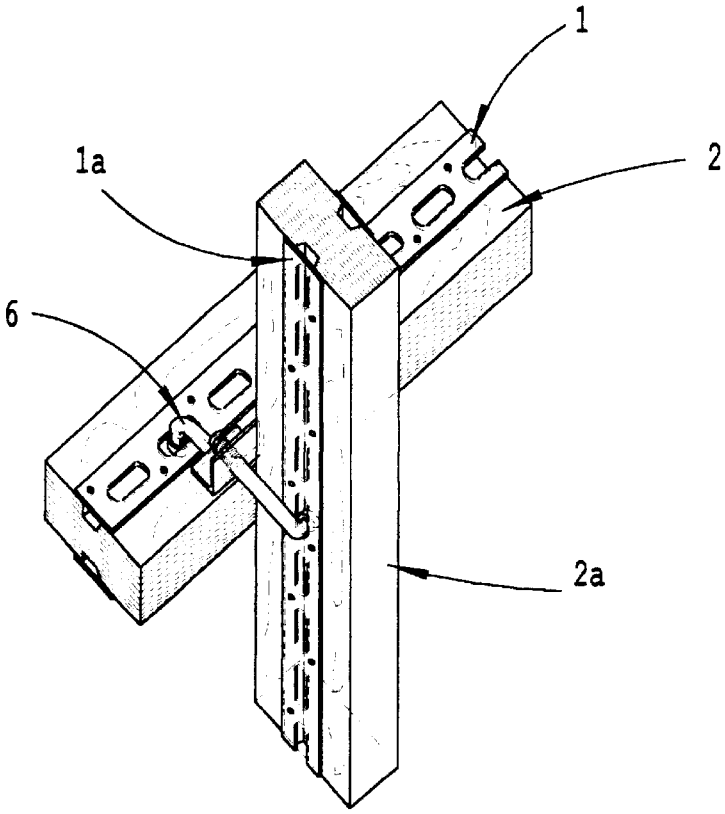
FIG. 5 is an isometric view of the attach plate bracket means and the associated support member connection to the load-bearing support member by the means of a attach clamp fastener in concrete formwork construction.

In the formwork construction environment, of FIGS. 4 of the drawings, the support member 2*a* and the attach plate bracket la can be affixed along the length of support member 2 and attach plate bracket 1 by the means of the attach clamp 6 and attach fastener 7. As can best be seen in FIG. 5 of the drawings the support member 2*a* can incorporate an attach plate bracket 1*a* at one side surface and an attach plate bracket 1*b* on the opposite side surface. The support member 2*a* and the attach plate bracket 1*a* can be attached along the length of the support member 2 and the attach plate bracket 1 by the means of the attach clamp 6 at the attach plate bracket 1 and attach clamp 6*a* at the attach plate bracket 1*a*.

Figure 6:
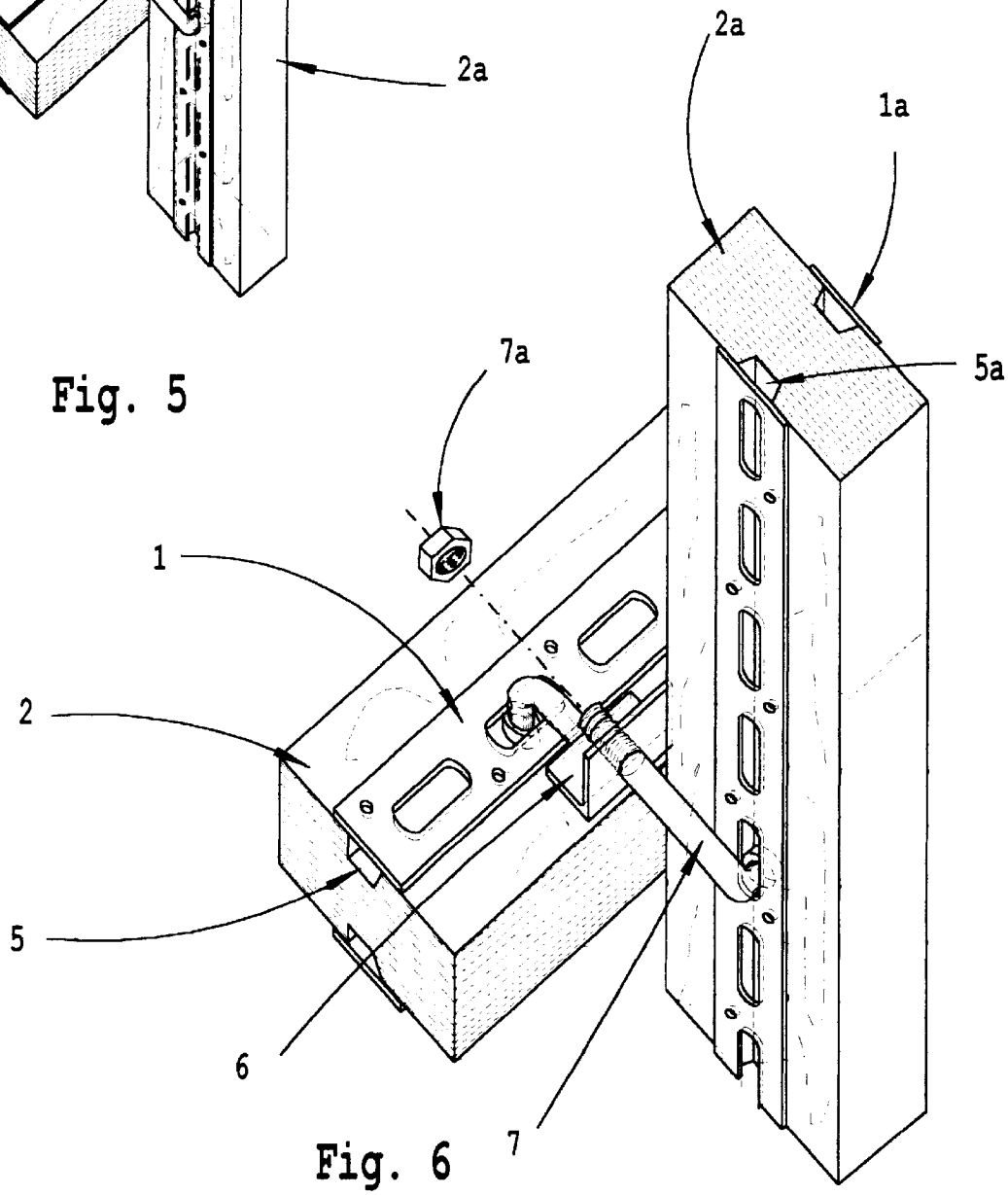
FIG. 6 is a fragmentary isometric view with the associated attach clamp fastener and the attach plate bracket system to a load-bearing support member with the associated adjustment means in concrete formwork construction.

As can best be seen in FIG. 6 of the drawings, in order to finalize installation of support member 2*a* in relationship to the support member 2, following engagement of gripping means attach fastener 7 is secured at access recess 5*a* to support member 2 at the attach clamp 6 at the access recess 5 by the means of the attach fastener 7. To finalize gripping of the attach fastener 7 and the attach clamp 6, the attach fastener nut 7*a* is installed to the attach fastener 7.

Figure 7:
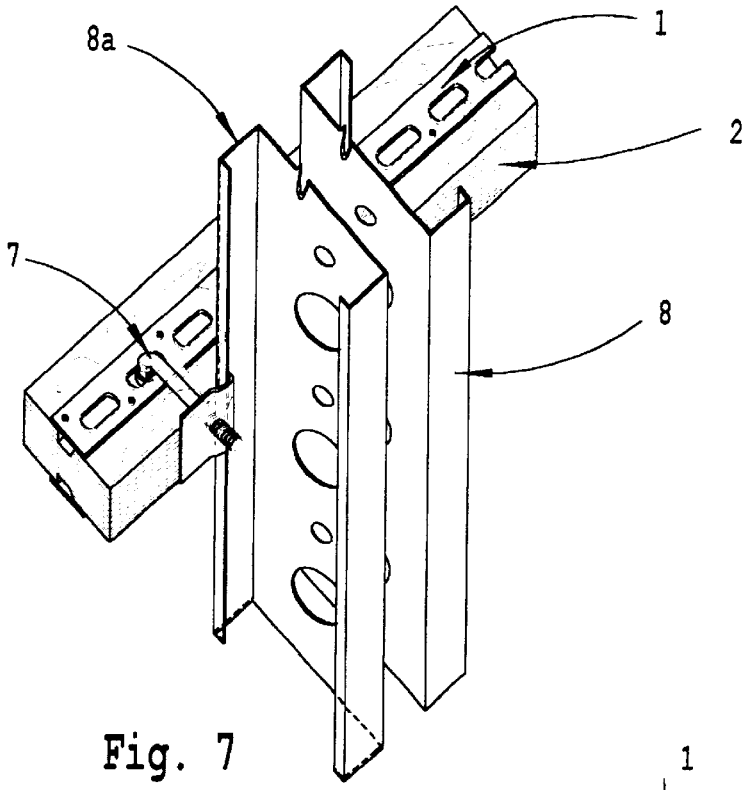
FIG. 7 is an isometric view of the attach plate bracket means and the associated support member connection to the load-bearing steel member by the means of a attach clamp fastener in. concrete formwork construction.
Figure 8:
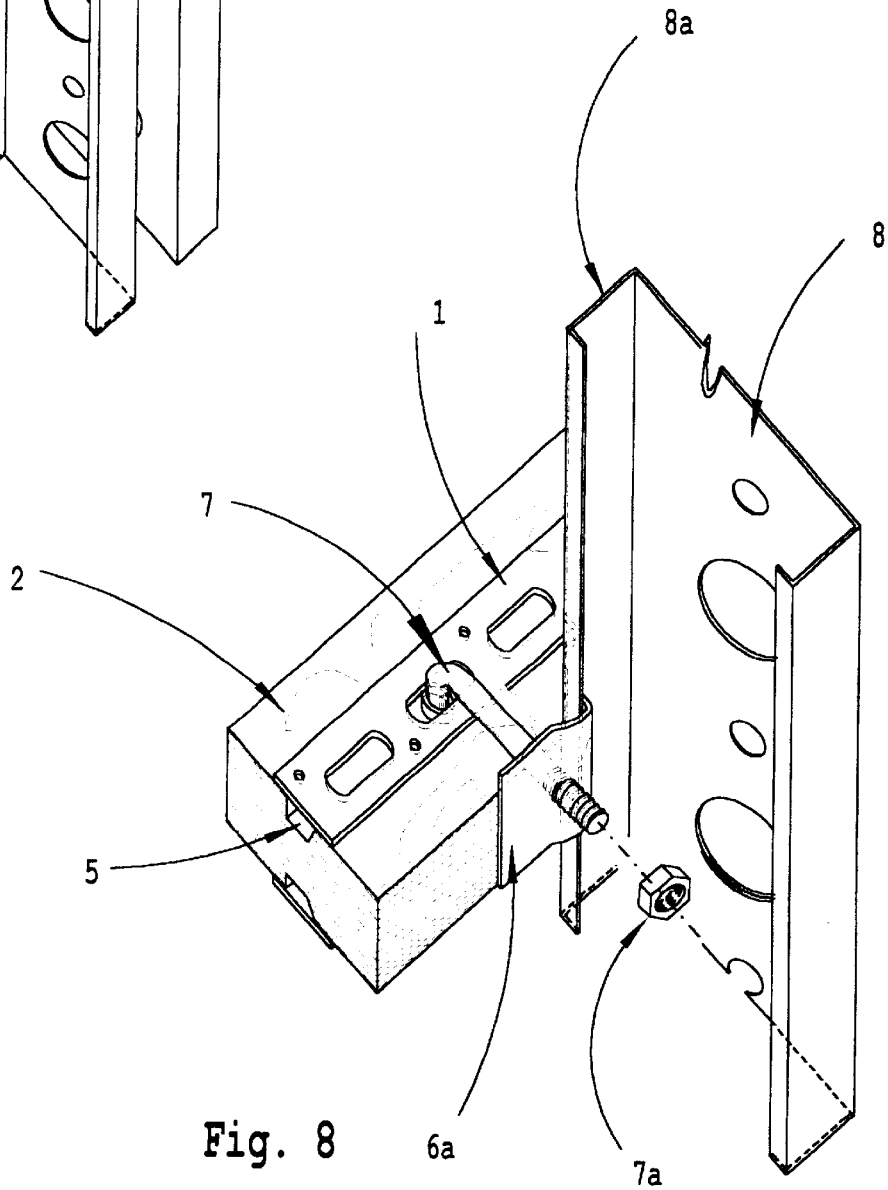
FIG. 8 is a fragmentary isometric view with the associated attach clamp fastener and the attach plate bracket system to a steel load-bearing member with the associated adjustment means in concrete formwork construction.

In the formwork construction environment as in FIG. 7 of the drawings the load-bearing member 8 can be affixed along the length of support member 2 and attach plate bracket 1 by the means of the attach fastener 7. As can best be seen in FIG. 8 of the drawings the load-bearing member 8 can be attached along the length of the support member 2 and the attach plate bracket 1 by the means of the attach fastener 6 at the attach plate bracket 1 and attach clamp 6*a* at the flange of load-bearing member 8. In order to finalize installation of load-bearing member 8 in relationship to the support member 2, following engagement of gripping means attach clamp 6*a* is secured at load-bearing member flange 8*a* to support member 2 at the attach fastener 7 at the access recess 5 and the attach fastener nut 7*a*. To finalize gripping of the attach clamp 6*a* and the attach fastener 6, the attach fastener nut 7*a* is installed to the attach fastener 7.

Figure 9:
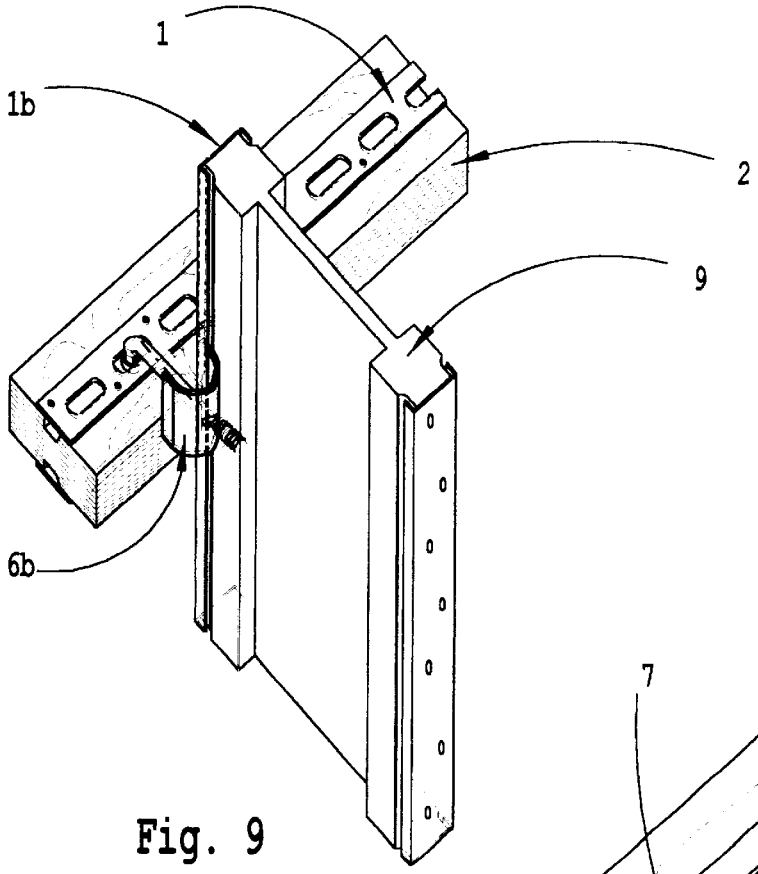
FIG. 9 is an isometric view of the attach plate bracket means and the associated support member connection to the I-shaped load-bearing member by the means of a attach clamp fastener in concrete formwork construction.

In the concrete wall construction environment as in FIG. 9 of the drawings the I-shaped load-bearing member 9 can mount along the length of the support member 2 by means of the attach plate bracket 1. The I-shaped load-bearing member 9 can be affixed along the length of the support member 2 and the attach plate bracket 1 with the attach clamp 6*b*.

Figure 10:
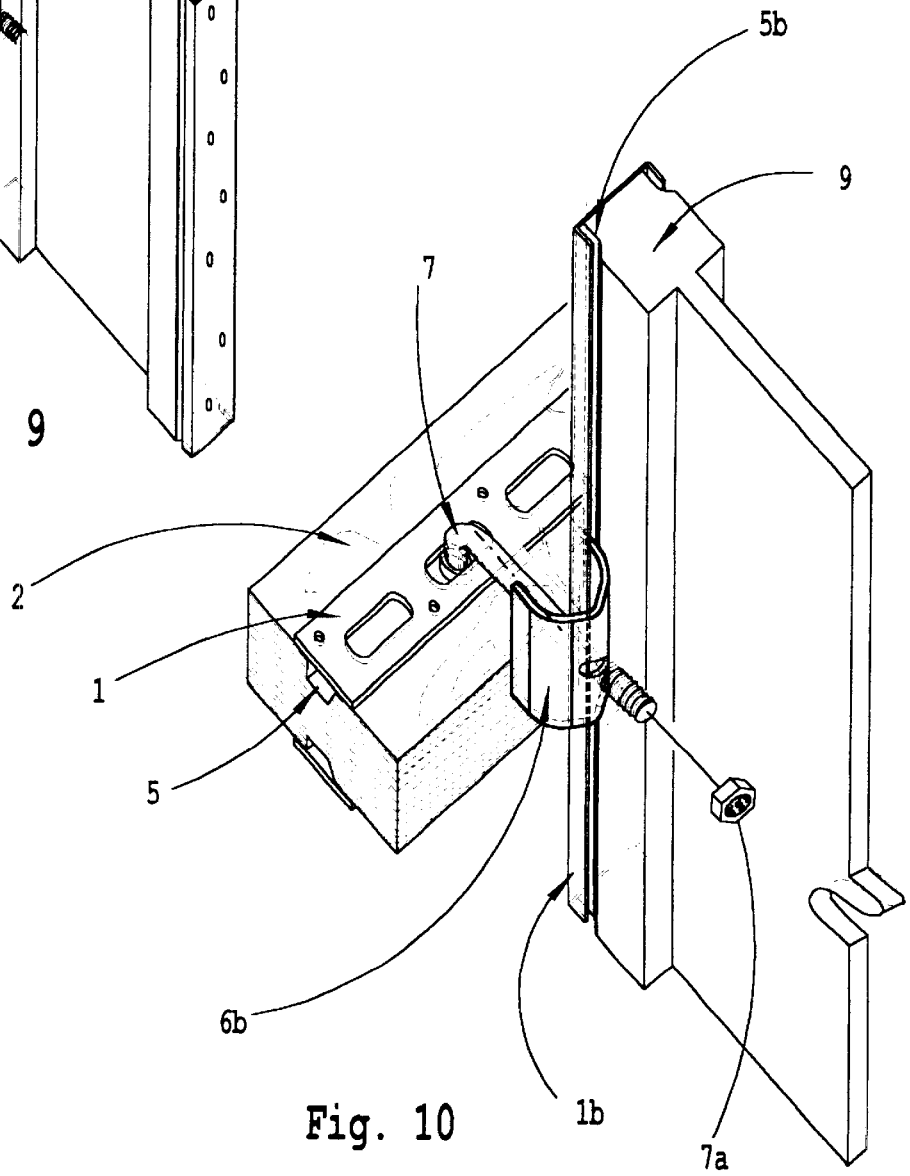
FIG. 10 is a fragmentary isometric view with the associated attach clamp fastener and the attach plate bracket system to a load-bearing I-shaped member with the associated adjustment means in concrete formwork construction.

As can best be seen in FIG. 10 of the drawings, in order to finalize installation of the I-shaped load-bearing member 9 in relationship to the support member 2, following engagement of gripping means attach clamp 6*b* is secured at recess 5*a* to support member 2 at the access recess 5 by the means of the attach fastener 7. To finalize gripping of the attach clamp 6*b* and the attach fastener 7, the attach fastener nut 7*a* is installed to the attach fastener 7.

Figure 11:
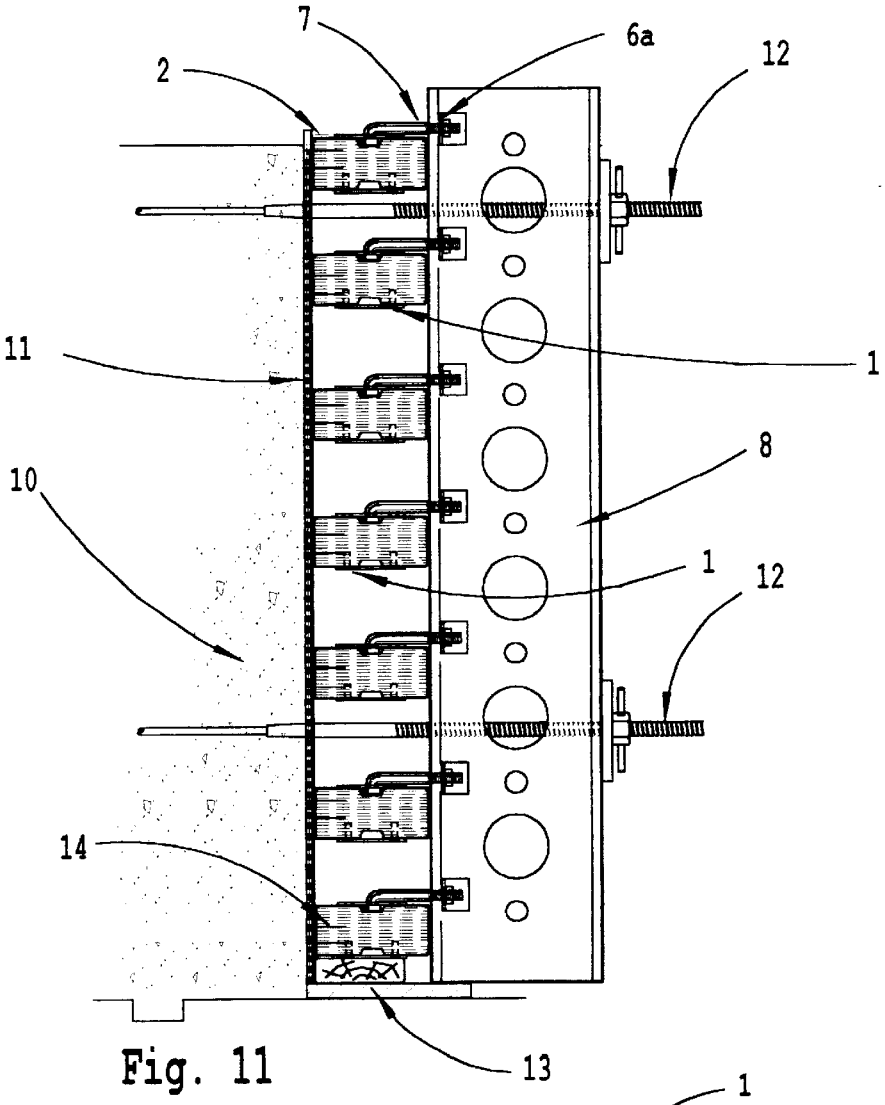
FIG. 11 is a side elevation view of the support member and the associated attach plate bracket system connected to the load-bearing steel member and the sheathing attached to the support member in a concrete wall construction application.
Figure 12:
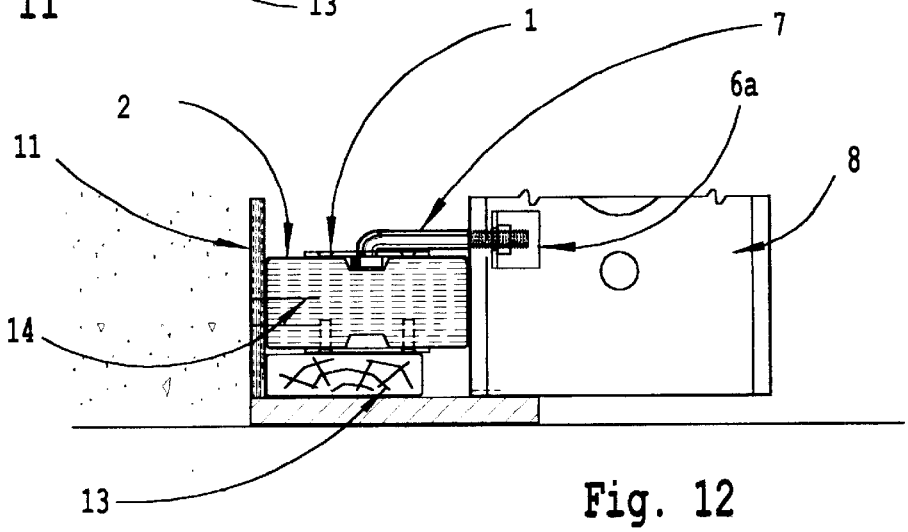
FIG. 12 is a fragmentary side view of the support member and the associated attach plate bracket system with the sheathing forming the concrete wall construction intersection with the base footing.

In the concrete wall forming environment as shown in FIG. 11 of the drawings in order to mount the support member 2 and the attach plate bracket 1, the attach fastener 7 and the attach clamp 6*a* is gripped on the load-bearing member 8. The concrete 10 is formed or molded by the sheathing 11, the sheathing 11 is affixed to the support member 2 by the means of nails 14, and the like. The construction load of the concrete 10 is controlled by the tie 12, attached to the load-bearing member 8. As can best be seen in FIG. 12 of the drawings the sheathing 11 is affixed to the support member 2 with affixing means such as nails 14 and the like, at the bottom of the load-bearing member 8. The load-bearing member 8 is supported with lumber blocking 13 and the like, and the support member 2 and the attach plate bracket 1 is affixed to the load bearing member 8 with gripping means attach fastener 7 and attach clamp 6*a*.

Figure 13:
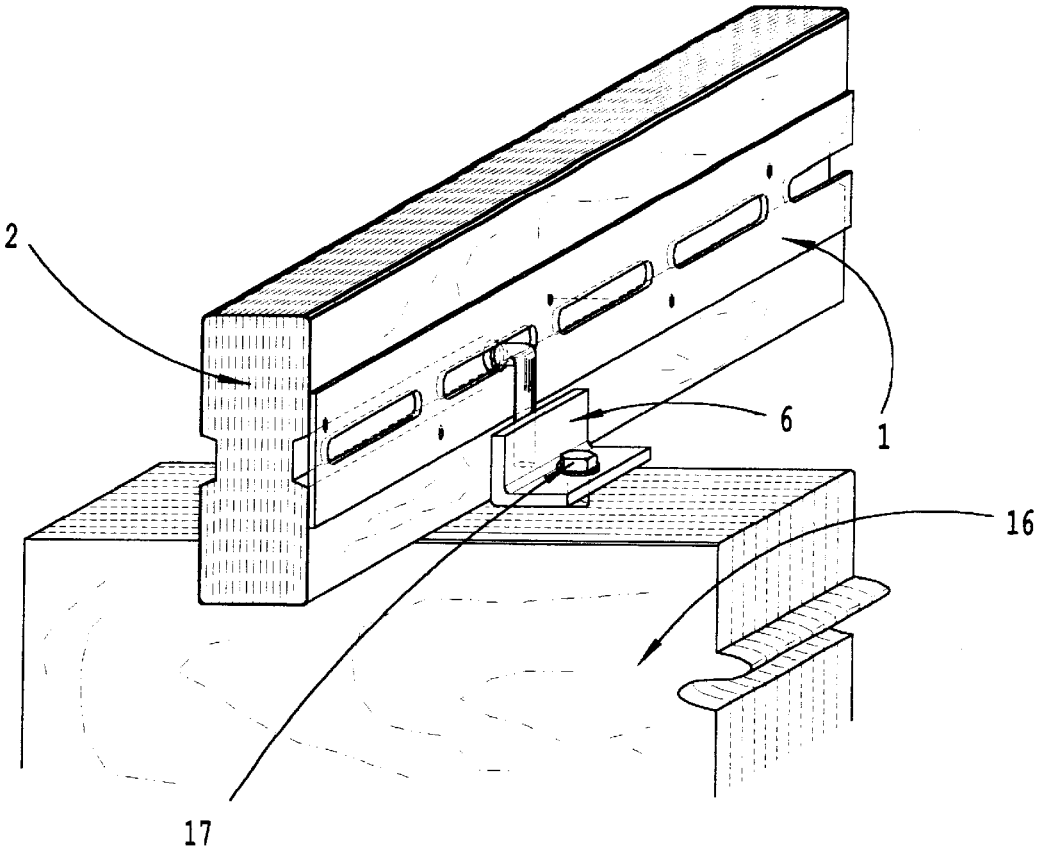
FIG. 13 is an isometric view of the support member and the associated attach plate bracket system with the horizontal load-bearing member and the associated attach clamp used on concrete slab support construction.

In the concrete slab construction environment in FIG. 13 of the drawings the support member 2 and the attach plate bracket 1 is affixed to the load-bearing member 16 with the attach fastener washer 6, and the like. To finalize the gripping of the attach clamp washer 6 the attach fastener 17, and the like, is screwed or fastened to the load-bearing member 16. As can best be seen in FIG. 14 of the drawings the support member 2 is affixed with the attach clamp washer 6, 6 is bearing at the attach plate bracket 1 at the access recess 5. To finalize the attachment of the support member to the load-bearing member, the attach clamp washer 6 is interconnected at the attach plate bracket 1 at the access recess 5 and bears against the load-bearing member 16, is gripped by the attach fastener 17.

Figure 14:
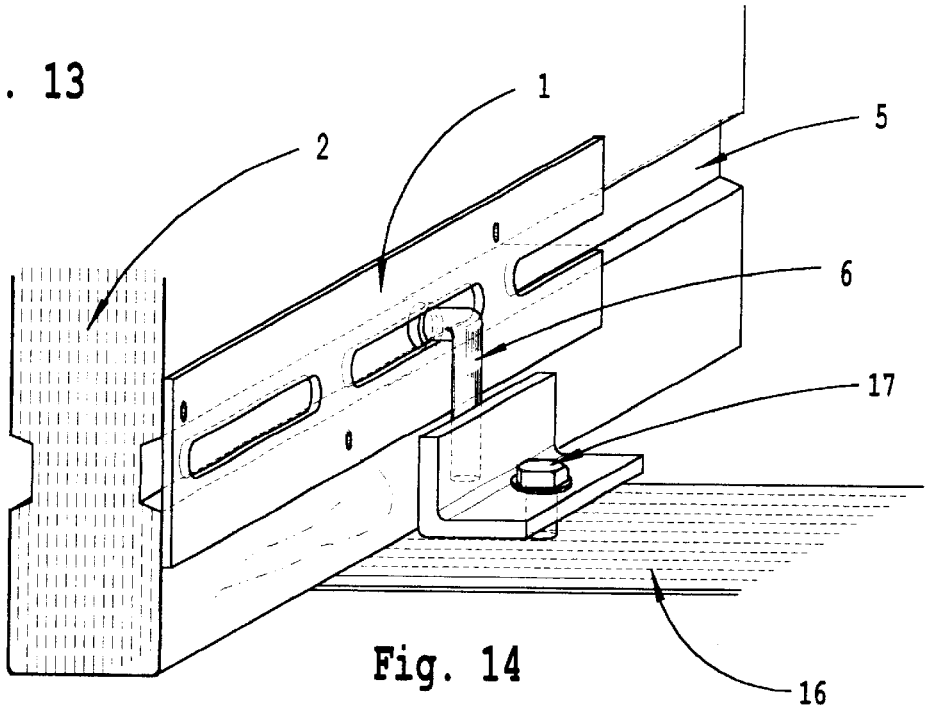
FIG. 14 is a fragmentary isometric view of the attach clamp and the associated attach plate bracket system used on concrete slab support construction.
Figure 15:
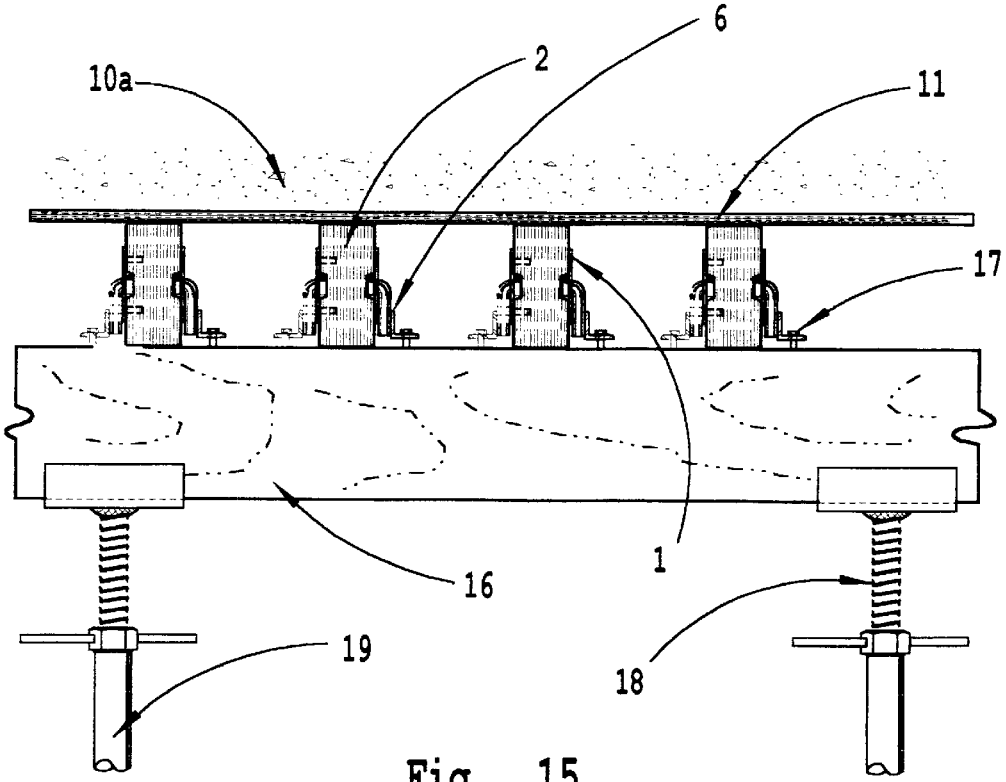
FIG. 15 is an elevation end view of the support member and the associated attach plate bracket system with the horizontal load-bearing member being used with associated supporting members in a concrete slab construction application.

In the concrete slab support environment in FIG. 15 of the drawings the support member 2 and the attach plate bracket 1 is affixed to the load-bearing member 16 with the gripping means as in FIG. 13–14. The concrete slab 10*a* is supported by the sheathing 11, 11 is supported by the support member 2. The support member 2 is supported by the load-bearing member 16, 16 is supported by the vertical support adjustment bracket 18 and the like, 18 is supported by the vertical shoring component 19, and the like.

Figure 16:
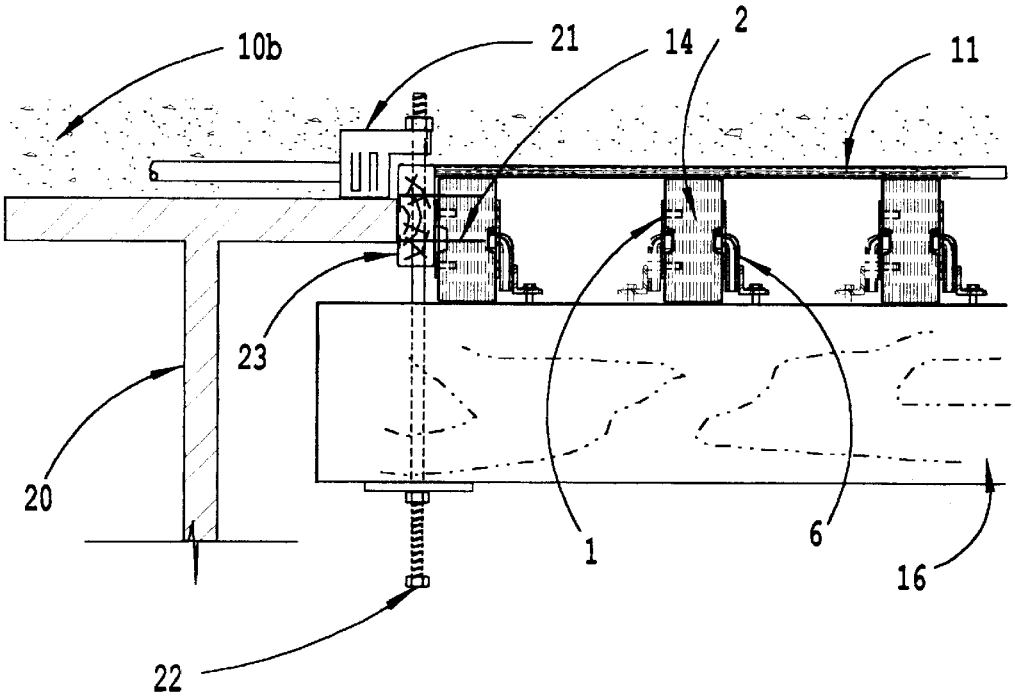
FIG. 16 is an elevation end view of the support member and the associated attach plate bracket system with the horizontal load-bearing member being used with associated supporting fasteners in a concrete bridge slab construction application.

Reference is made to the general use of the attach plate bracket 1 in the concrete bridge slab construction environment on a structural girder as shown in FIG. 16 of the drawings. In this concrete slab construction environment, the support member 2 and the attach plate bracket 1 is affixed to the load-bearing member 16 at the attach clamp washer 6. The concrete bridge slab 10*b* is supported by the sheathing 11, 11 is supported by the support member 2. The support member 2 and the attach plate bracket 1 is supported by the load-bearing member 16, 16 is supported by the adjustable support hardware 22 and the like, 22 is supported by the flange hanger 21 and the like, 21 is supported by the structural girder 20. The adjustable support hardware 22 has access to the load-bearing member 16 at the end of each forming block 23, 23 is supported with nails 14 and the like at the support member 2.

Figure 17:
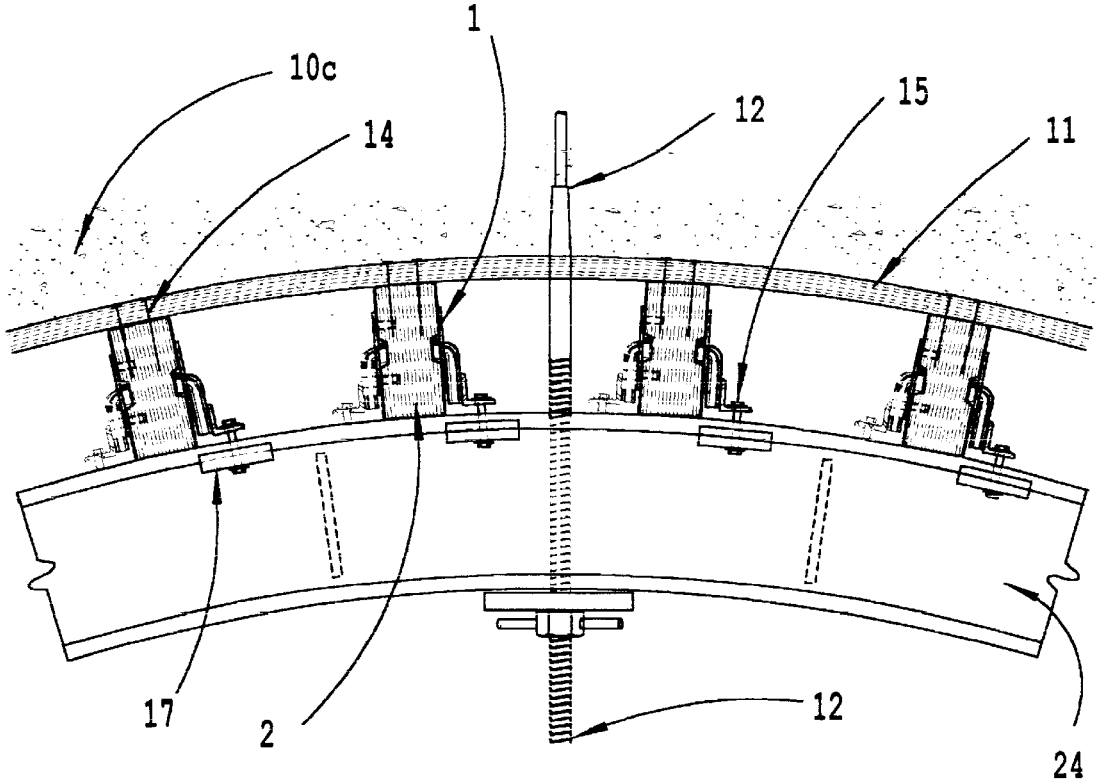
FIG. 17 is an elevation end view with the support member and the associated attach plate bracket system used with a steel curved load-bearing member used in a concrete wall forming or concrete slab support construction.

In the concrete wall construction environment and the concrete slab support environment as shown in FIG. 17 the curved concrete 10*c* is supported by sheathing 11, 11 is supported by the support member 2 and the attach plate bracket 1. The sheathing 11 is affixed to the support member 2 with nails 14 and the like. The support member 2 and the attach plate bracket 1 is affixed to the curved load-bearing member 24 with the gripping means as shown in FIG. 7–8 and FIG. 13–14. The attach clamp washer 6 bears against the attach plate bracket 1 and against the flange surface of the curved load-bearing member 24. To finalize the installation of the support member 2 and the attach plate bracket 1 to the curved load-bearing member 24, the attach clamp 17 bears against the opposite side of the curved load-bearing member flange 24. To finalize the gripping connection of the support member 2 and the attach plate bracket 1 to the curved load-bearing member 24, the attach fastener 15 is installed between the attach clamp washer 6 and the attach clamp 17. The construction load of the curved concrete 10*c* is supported by the curved load-bearing member 24 by the means of the tie 12.

Figure 18:
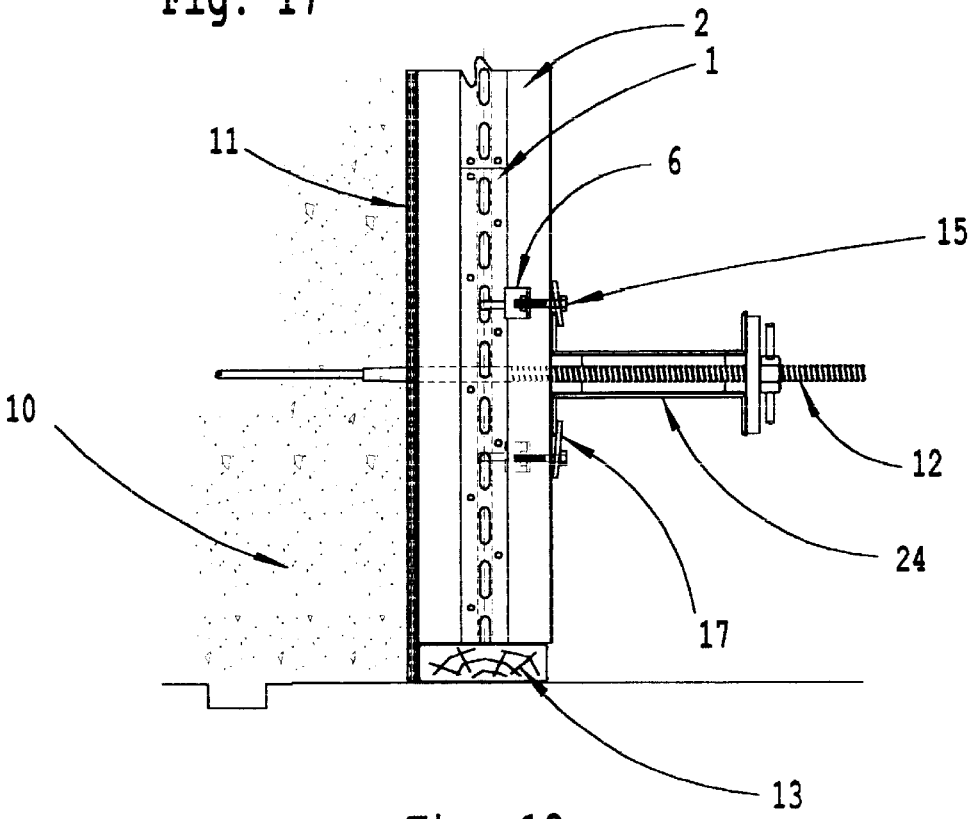
FIG. 18 is an elevation side view of a vertical support member and the associated attach plate bracket used with a horizontal load-bearing member and associated load carrying tie in concrete wall construction.

In curved concrete wall construction as shown in FIG. 18 of the drawings the vertical support member 2 and the attach plate bracket 1 is affixed to the horizontal curved load-bearing member 24 as in FIG. 7–8 and FIG. 13–14. The curved wall concrete 10 is formed or molded by the sheathing 11, 11 is supported by the vertical support member 2 and the attach plate bracket 1. The load-bearing member 24 is affixed to the support member 2 and the attach plate bracket 1 with the gripping means 17, and the like, and with the attach fastener 6, and the like. To finalize the gripping connection of the support member 2 and the attach plate bracket 1 to the load-bearing member 24, the attach fastener 15 is installed between the attach clamp washer 17 and the attach clamp 6. The vertical support member 2 and the attach plate bracket 1 is supported by the means of a lumber plate 13 or the like. The load-bearing member 24 supports the construction load of the curved concrete wall 10 by the means of the tie 12.

Figure 19:
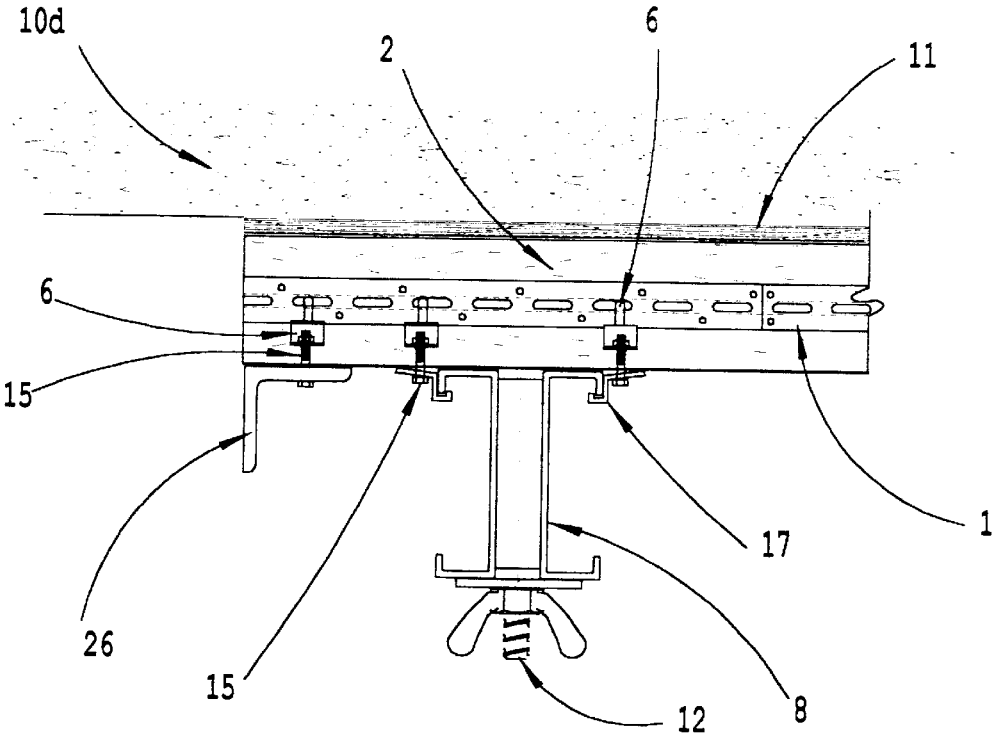
FIG. 19 is an elevation side view of the support member and the associated attach plate bracket system with the load-bearing member and the associated attach clamp fastener and the attach end angle and the associated attach clamp fastener used in concrete wall forming construction or concrete slab support construction.

As can best be seen in FIG. 19 of the drawings, in the concrete wall construction. environment or the concrete slab support environment, the attach plate bracket 1 provides an. attachment location for the load-bearing member 8, as shown in FIG. 7, and an attachment location for the panel attach angle 26. The concrete 10*d* is supported or molded by the sheathing 11, 11 is supported by the support member 2 and the attach plate bracket 1. The load-bearing member 8 is affixed to the support member 2 and the attach plate bracket 1 by the means of an attach clamp washer 17, and the like, and an attach clamp 6, and the like, with the final gripping installed at the attach fastener 15. The panel attach angle 26 is affixed to the support member 2 and the attach plate bracket 1 by the means of the attach clamp washer 6. To finalize the installation of the panel attach angle 26 the gripping attach fastener 15 is installed between the attach clamp washer 6 and the panel attach angle 26.

Figure 20:
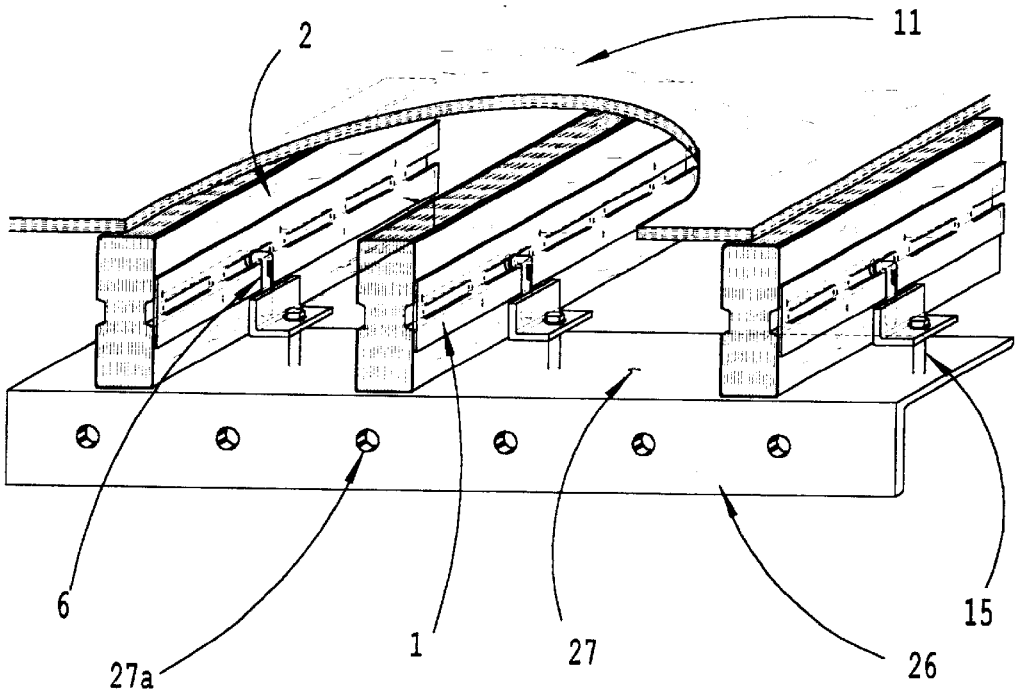
FIG. 20 is a fragmented isometric view of the support member and the associated attach plate bracket system with the attach end angle and the associated attach clamp fasteners in concrete wall construction or concrete slab support construction.

As can best be seen in FIG. 20 of the drawings the panel attach angle 26 is installed on a series of support members 2 and attach plate bracket brackets 1. The attach clamp washer 6 bears at the attach plate bracket 1 and at the panel attach angle 26. To finalize the installation of the panel attach angle 26 on the support member 2 and the attach plate bracket 1 the attach fastener 15 is installed at the attach clamp washer 6 and through the panel attach angle hole 27.

Figure 21:
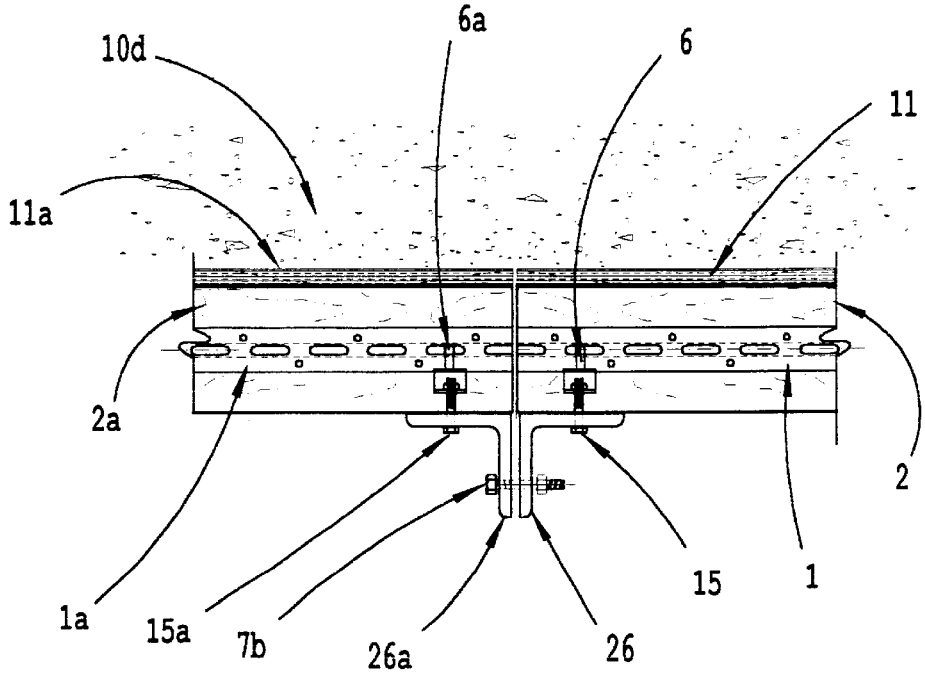
FIG. 21 is an elevation side view of support members with the attach end angles with the associated attach clamp fasteners in concrete wall construction or concrete slab support construction.

In the concrete wall formwork environment or concrete slab support environment the continuation of support of concrete 10*d* can best be seen in FIG. 21 of the drawings. The concrete 10*d* is supported or molded by sheathing 11, 11 is supported by support member 2. The continuation of the concrete 10*d* support or molding is by the sheathing 11*a* that is supported by support member 2*a*. The support member 2 is attached to an opposing support member 2*a* by the means of the panel attach angle 26, 26 is affixed to the attach plate bracket 1 as shown in FIG. 19–20 and the attach plate bracket 26*a* is affixed to the attach plate bracket 1 a as shown in FIG. 19–20. The panel attach angle 26 is affixed to the panel attach angle 26*a* by means of the attach fastener 7*b*.

Figure 22:
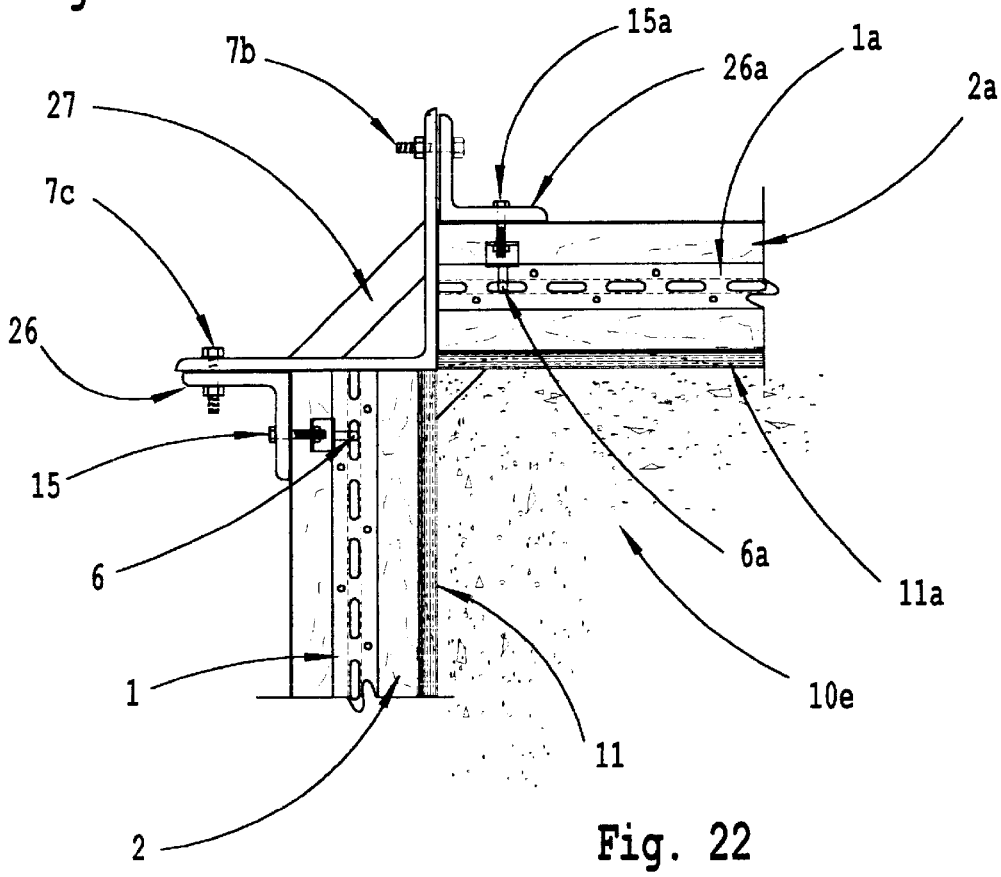
FIG. 22 is an elevation side view of the support members and associated attach plate bracket system and the comer angle support and the associated fasteners in concrete comer wall construction.

In the concrete wall construction environment the outside corner molding can best be seen in FIG. 22 of the drawings whereby the panel attach angle 26 is affixed to the support member 2 and the attach plate bracket 1 as shown in FIG. 19–20, and the panel attach angle 26*a* is affixed to the support member 2*a* and the attach plate bracket la as shown in FIG. 19–20. The comer concrete 10*e* is formed or molded, as shown in FIG. 22, by the sheathing 11 and 11*a* and the outside comer support angle 27. The outside comer support angle 27 is affixed to the panel attach angle 26 by the means of the attach fastener 7*c*, and the panel attach angle 26*a* is affixed to the outside comer angle 27 by the means of the attach fastener 7*b*.

Figure 23:
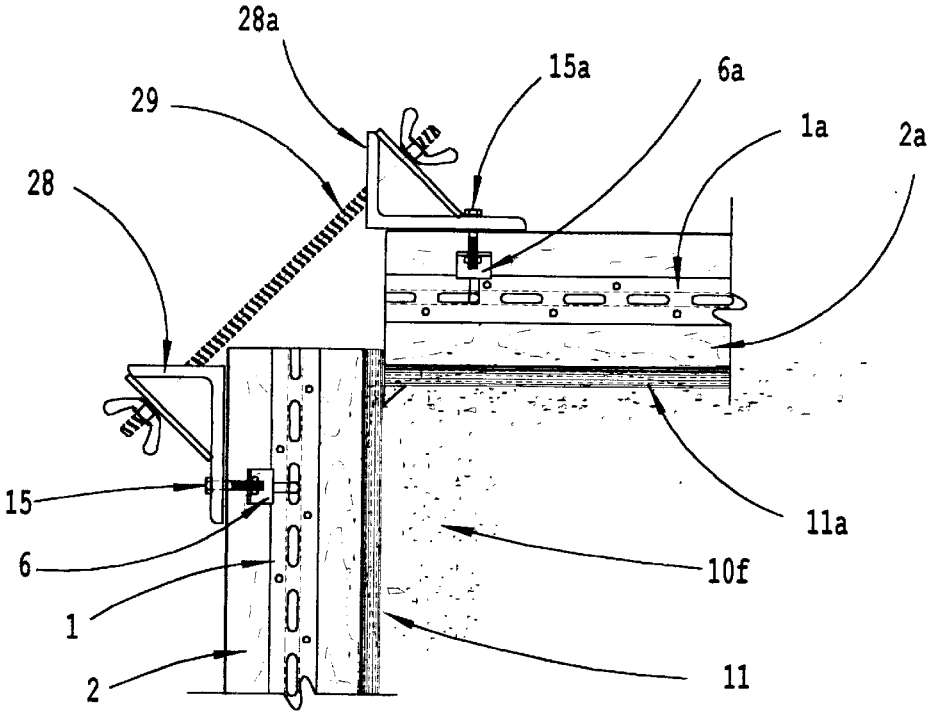
FIG. 23 is an elevation side view with the support members and the associated attach plate bracket system with the comer brace angle and the associated fasteners in concrete corner wall construction or concrete slab support construction or concrete column form construction.

In the concrete wall construction environment the outside corner bracing can best be seen, but not limited to, FIG. 23 of the drawings whereby the brace attach angle 28 is affixed to the support member 2 and the attach plate bracket 1 as shown in FIG. 19–20, and the brace attach angle 28*a* is affixed to the support member 2*a* and the attach plate bracket 1*a* as shown in FIG. 19–20. The corner concrete 10*f* is formed or molded, as shown in FIG. 23, by the sheathing 11 and 11*a* and the brace attach angle 28 and the brace attach angle 28*a*. The brace attach angle 28 is affixed to the brace attach angle 28*a* by the means of the brace attach fastener 29. To finalize the comer concrete 10*f* the support member 2 and the attach plate bracket 1 as well as the support member 2*a* and the attach plate bracket 1*a* are affixed to the brace attach angle 28 and the brace attach angle 28*a* and the engagement of the brace attach fastener 29.

Figure 24:
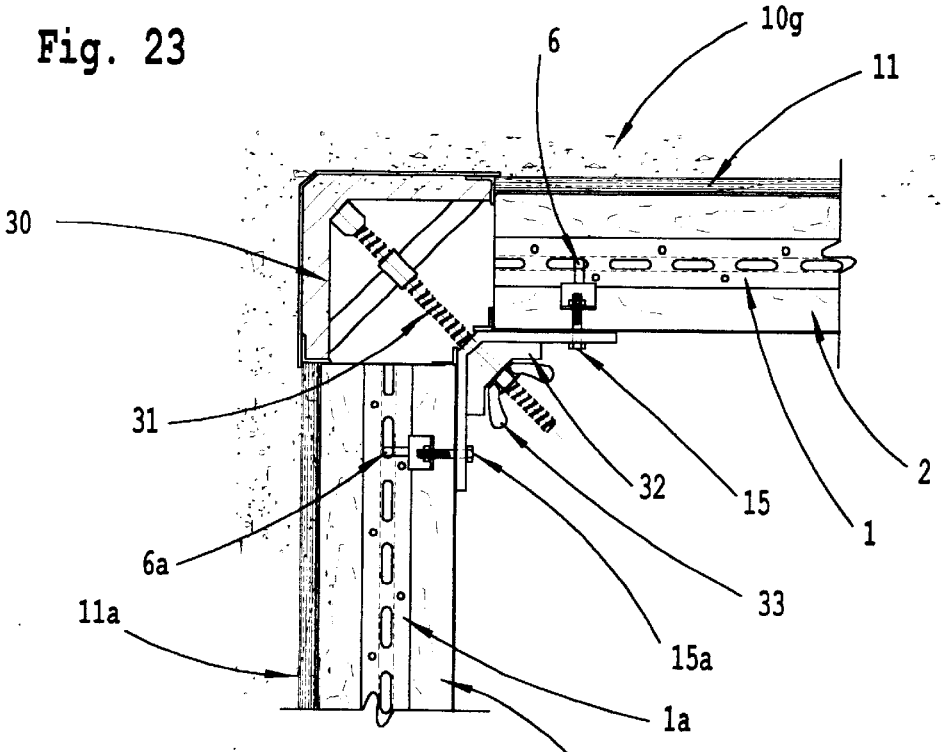
FIG. 24 is an elevation side view of the support member and the associated attach plate bracket system with the inside comer form angle and the associated attach clamp fasteners in concrete wail construction or concrete beam support construction.

In the concrete wall construction environment and the concrete slab construction environment the inside corner molding or support can best be seen in FIG. 24 of the drawings whereby the inside comer angle 30 is affixed to the support member 2 and support member 2*a* by the gripping means of the inside corner brace 32 and the inside corner fastener 31. The inside corner brace 32 is affixed to the support member 2 and the support member 2*a* as shown in. FIG. 19–20. The inside comer brace 32, as shown in FIG. 24, is affixed to the attach plate bracket 1 and the attach plate bracket 1*a* by the gripping means of the attach fastener 6 and the attach fastener 6*a*. To finalize the engagement of the inside corner angle 30 the inside corner fastener nut 33 is engaged at the inside corner brace 32.

Variations or modifications to the structure, method of assembly, and usability of the attach bracket for structural concrete forming of this invention may occur to those skilled in the art upon reviewing the description of the embodiment provided herein.

I claim:

1. A structural concrete forming system for use for concrete forming of one of a concrete wall, slab, or foundation, said system including a series of support members, at least one support brace for temporarily connecting to the support members and to hold them into position for concrete forming, an attach plate bracket secured to at least one side of each support member, and another attach plate bracket secured to at least one side of the support brace, and a series of attach fasteners interconnecting between the attach plate brackets of both the support members and the support brace, and when tightened, further securing and tightening of the attached plate brackets of the support members with that of the support brace, thereby securing the structural concrete forming system for usage.

2. The concrete forming system of claim 1, and whereir each support member including a recess provided along the support member, and underlying the attach plate bracket connected to the support member each attach plate bracket having a series of apertures provided therethrough, and each attach fastener having a head that secures through the attach plate bracket for securement thereto, and for further connecting with the support brace during erection of the structural concrete forming system.

3. The structural concrete forming system of claim 2 and wherein there are a series of fasteners positioned within apertures provided along the attach plate bracket of the support members, and said attach fasteners being secured to the attach plate brackets, and for further connecting with the support brace during erection of the structural concrete forming system.

4. The concrete forming system of claim 3 wherein said support brace is a load bearing member.

5. The concrete forming system of claim 4 and including attach plate brackets connected to opposite sides of the support member, and capable of having at least one attach fastener securing to each of the attach plate brackets, and said attached fasteners being disposed for securement with the attach plate bracket connecting with the support braces.

6. The concrete forming structure of claim 5, and wherein said support member formed from laminated veneer lumber.

7. The concrete forming structure of claim 6 and wherein said support member formed as I-shaped wood members.

8. The concrete forming structure of claim 7 and wherein said load bearing support brace is formed of laminated veneer lumber.

9. The concrete forming structure of claim 8 and wherein said load bearing support brace is formed as an I-shaped wood member.

10. The concrete forming structure of claim 9 and further including an attach clamp, said attach clamp arranged contiguously against the load bearing support brace, said attach fastener being secured to said attach clamp, and a further attach fastener securing with the attach clamp, and also securing with the other attach plate bracket connecting with the load bearing support brace, whereby upon tightening of the attach fasteners to the attach clamp, the support members temporarily and tightly connect with the load bearing support brace.

11. The concrete forming structure of claim 10, and wherein said forming structure is arranged linearly for forming a straight wall.

12. The concrete forming structure of claim 10, and wherein said forming structure is arranged arcuately, for forming a curved concrete wall.

13. The concrete forming structure of claim 10, wherein said structure for use for pouring a concrete wall, and further including a tie rod, said tie rod extending into the area where the concrete wall is to be poured, and said tie rod also connecting with the load bearing support brace to provide support thereto.

14. The concrete forming structure of claim 10, and further including a flange hanger, said flange hanger operatively associated with the end support member of the forming structure, and arranged adjacent to a structural girder, to provide for attachment of the concrete forming structure to the structural girder in the formation of a concrete wall.

15. The concrete forming structure of claim 10, and including a panel attach angle connecting to the ends of each support member, a fastener connecting between the panel attach angles, and when tightened, securing the ends of each support member contiguously together, and thereby forming a corner for the structural concrete forming system.

16. The concrete forming structure of claim 15, and wherein said concrete forming structure, through the arrangement of the panel attach angles, as tightened, provides for the formation of a comer at a specified angular relationship in the formation of the structural concrete forming system.

17. The concrete forming structure of claim 10, and including an inside comer angle operatively associated with the ends of a pair of adjacent support members, a corner angle operatively associated with the inside comer angle, and when tightened, securing the support members and the concrete forming structure at an angular relationship at the proposed comer of the formed concrete wall.

18. The concrete forming structure of claim 7 and wherein said load bearing support brace is formed as an aluminum beam.

19. The concrete forming structure of claim 5 and wkerein said support menber formed from aluminum.

20. The concrete forming structure of claim 2 and wherein the head of each fastener including flattened surfaces to facilitate the connection of the fasteners through the apertures of the plate brackets.

* * * * *